US007318390B2

(12) United States Patent
Amy

(10) Patent No.: US 7,318,390 B2
(45) **Date of Patent: *Jan. 15, 2008**

(54) DECK MOUNTED DEVICE WITH GASKET

(76) Inventor: Ron Amy, 153 Laurelwood Dr., Novato, CA (US) 94949-8427

( * ) Notice: Subject to any disclaimer, the term of this patent is extended or adjusted under 35 U.S.C. 154(b) by 39 days.

This patent is subject to a terminal disclaimer.

(21) Appl. No.: 11/376,655

(22) Filed: Mar. 14, 2006

(65) Prior Publication Data

US 2006/0201411 A1 Sep. 14, 2006

Related U.S. Application Data

(63) Continuation-in-part of application No. 10/689,377, filed on Oct. 20, 2003, now Pat. No. 7,032,528.

(51) Int. Cl.
*B63B 21/04* (2006.01)

(52) U.S. Cl. ..... 114/364; 114/218

(58) Field of Classification Search ..... 114/218, 114/201 R; 277/593, 639, 640, 312, 598, 277/611, 638; 440/112; 411/542
See application file for complete search history.

(56) References Cited

U.S. PATENT DOCUMENTS 2,752,814 A * 7/1956 Iaia ..... 411/542
3,042,248 A * 7/1962 Krueger ..... 220/240
3,126,859 A 3/1964 Bigelow
5,291,845 A * 3/1994 Vallery ..... 114/203
6,837,498 B2 * 1/2005 Fluck et al. ..... 277/630
6,968,796 B1 * 11/2005 Burke ..... 114/218
7,032,528 B2 * 4/2006 Amy ..... 114/218

* cited by examiner

*Primary Examiner*—Ed Swinehart
(74) *Attorney, Agent, or Firm*—Craig M. Stainbrook; Stainbrook & Stainbrook, LLP

(57) ABSTRACT

A deck mounted for installation on the surface of a vessel deck having one or more bolt holes. The apparatus includes one or more base portions, each having a recess region defined by a perimeter wall bounding the perimeter of the base portion. The perimeter walls each have an underside rim. One or more threaded members are provided for insertion through the bolt holes in the vessel deck, and complementary threaded female members are provided, one each to receive and tighten onto a threaded rod. A resilient gasket is disposed in the recess region within the confines of the perimeter wall. The threaded rod passes through the gasket hole, such that when the threaded rods are inserted through the vessel deck, and received by and tightened into the respective threaded female members, the gaskets are displaced and deformed so as to protrude between the underside rims of the perimeter walls and the upper surface of the vessel deck.

10 Claims, 6 Drawing Sheets

DECK MOUNTED DEVICE WITH GASKET

CROSS REFERENCES TO RELATED APPLICATIONS

The present application is a continuation-in-part of U.S. Utility patent application Ser. No. 10/689,377, filed Oct. 20, 2003 now U.S. Pat. No. 7,032,528.

STATEMENT REGARDING FEDERALLY SPONSORED RESEARCH OR DEVELOPMENT

Not applicable.

THE NAMES OR PARTIES TO A JOINT RESEARCH AGREEMENT

Not applicable.

INCORPORATION-BY-REFERENCE OF MATERIAL SUBMITTED ON A COMPACT DISC

Not applicable.

BACKGROUND OF THE INVENTION

1. Field of the Invention

The present invention relates generally to devices mounted to a vessel deck, and more particularly to deck mounted devices having a recess and a gasket disposed in the recess.

2. Discussion of Related Art Including Information Disclosed Under 37 CFR §§1.97, 1.98

Sailing vessels and power boats must be restrained from drifting away from a dock or mooring when stationed in port. To secure the vessel, rope cleats are mounted around the perimeter of the vessel deck so that a rope secured to the dock may be tied to the vessel, thus restraining the vessel.

Most commonly, cleats are simply bolted to the deck. Conventional cleats have an elongate bar supported a few inches above the deck surface with a pair of support structures. Each support structure has a female aperture that can accept a standard bolt or has a threaded post cast into the underside of the support structure. Each stud penetrates an aligned aperture in the deck of the vessel and a mating nut is attached to the threaded studs from the underside of the deck, thus securing the cleat to the deck.

In addition to cleats, several other devices are commonly mounted to vessel decks, including most notably, antenna mounts and deck fill caps, such as those used for gas and water fill or for waste removal. These devices are commonly secured to a deck in the same manner as described above for cleats.

The conventional method of attaching devices to vessel deck surfaces has several disadvantages. Typically, when devices are attached to a vessel deck, the space between the deck and the flat bottom of the cleat or fill cap or antenna mount is generally filled with a caulking material or a flexible washer such as rubber or the like. Unfortunately, tightening the nut forces the flat underside of the support structure onto the surface of the deck, causing caulking material to be squeezed out or any rubber washer to be severely distorted, compromising its seal around the stud. Additionally, the marine environment includes dramatic temperature swings, humidity changes, corrosive salt water and air, all of which can cause caulking and rubber washers to deteriorate, thus creating a pathway for water to travel and eliminating the protective cushion provided, which may result in damage to the deck caused by the device itself. When caulking deteriorates or when the edges of an exposed gasket break down, water can penetrate to the threaded post and travel down the post sides to the underside of the deck. The resulting water damage may create the need for expensive and time consuming repairs. Moreover, if the cleat support structures are resting on a compressible gasket material such as rubber or the like, unwanted movement occurs from side loads when dock lines pull on the cleat.

A further disadvantage in using a compressible gasket is in the increase of flex loads on the threaded stud fasteners and attached nuts. This may result in mechanical failure causing the cleat to break away from the deck and the moored boat to drift away from its mooring.

BRIEF SUMMARY OF THE INVENTION

The present invention is mechanical configuration providing a method and apparatus for deck mounted devices for vessels, such devices including rope cleats, antenna mounts, fill caps, and the like. A primary object of the invention is to provide a deck mounted apparatus, and means for securing such an apparatus, so as to create a water tight seal that prevents water intrusion through the deck of a vessel.

Another object of the invention is to provide an improved means for securing a device to a vessel deck in such a way that the device makes firm contact with the vessel deck.

Yet another object of the invention is to provide an improved means for securing a device to a vessel deck that will withstand the lateral forces.

Other novel features which are characteristic of the invention, as to organization and method of operation, together with further objects and advantages thereof will be better understood from the following description considered in connection with the accompanying drawings, in which preferred embodiments of the invention are illustrated by way of example. It is to be expressly understood, however, that the drawings are for illustration and description only and are not intended as a definition of the limits of the invention. The various features of novelty that characterize the invention are pointed out with particularity in the claims annexed to and forming part of this disclosure. The invention does not reside in any one of these features taken alone, but rather in the particular combination of all of its structures for the functions specified.

There has thus been broadly outlined the more important features of the invention in order that the detailed description thereof that follows may be better understood, and in order that the present contribution to the art may be better appreciated. There are, of course, additional features of the invention that will be described hereinafter and which will form additional subject matter of the claims appended hereto. Those skilled in the art will appreciate that the conception upon which this disclosure is based readily may be utilized as a basis for the designing of other structures, methods and systems for carrying out the several purposes of the present invention. It is important, therefore, that the claims be regarded as including such equivalent constructions insofar as they do not depart from the spirit and scope of the present invention.

BRIEF DESCRIPTION OF THE SEVERAL VIEWS OF THE DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

Figure 1:
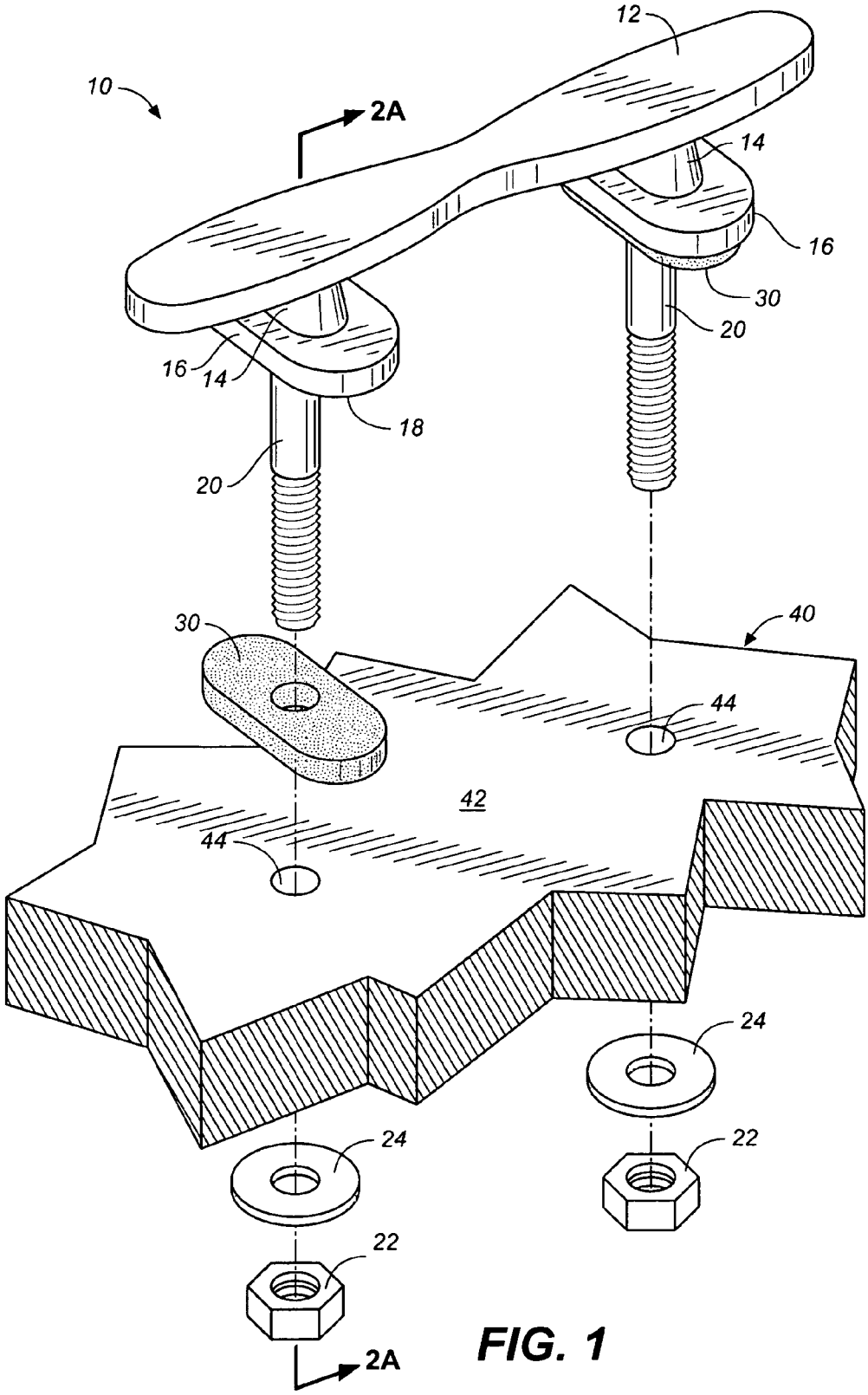
FIG. 1 is an upper left exploded perspective view of a preferred embodiment of the present invention showing a right gasket positioned in a recess.

Referring to FIGS. 1 through 8, wherein like reference numerals refer to like components in the various views, there is illustrated therein a new and improved deck-mounted device having a gasket, the first embodiment of which is generally denominated 10 herein.

Figure 2A:
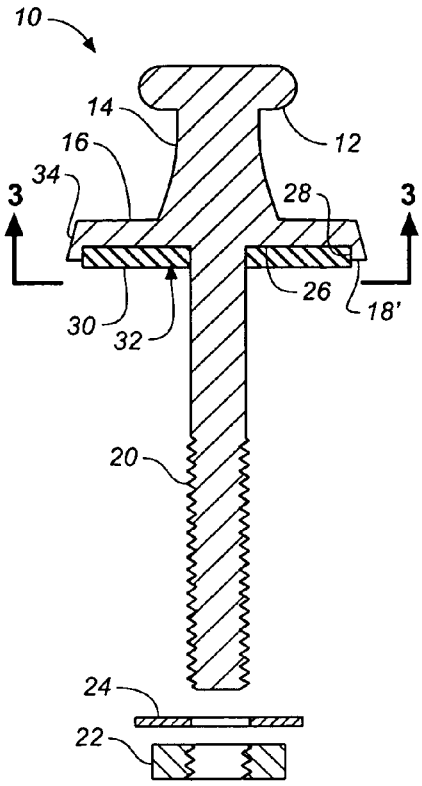
FIG. 2A is a cross-sectional side view in elevation taken along section line 2-2 in FIG. 1.
Figure 2B:
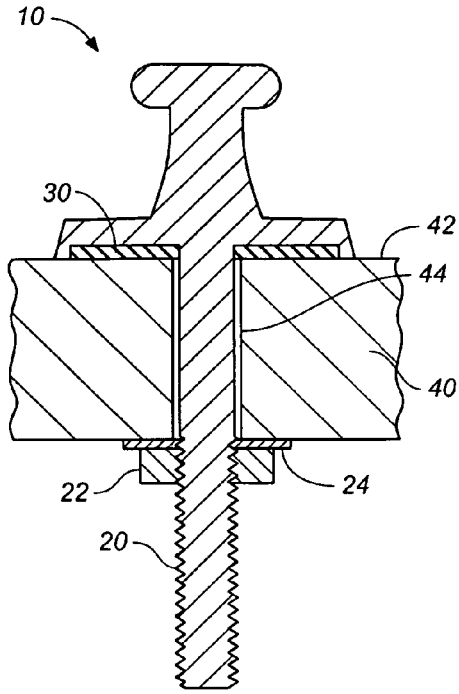
FIG. 2B is the same view as FIG. 2A shown after installation.
Figure 3:
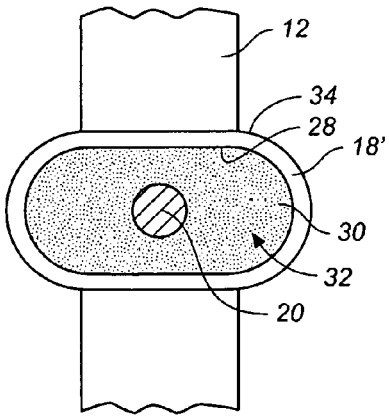
FIG. 3 is a bottom view of FIG. 2A taken along section line 3-3 in FIG. 2A.

Referring now to FIGS. 1 through 3 we see the first preferred embodiment of the inventive apparatus, namely a cleat 10, positioned for installation on a vessel deck 40. The process and mechanical characteristics detailed in this embodiment may be applied to alternate hardware and hardware elements, as discussed in detail below.

Cleat 10 is comprised of an elongate rigid bar 12 with a plurality of stand-offs 14. The distal end of each standoff 14 is enlarged to form a base 16. The base 16 has a generally planar underside 18 to conform to a mounting surface 42, which is also typically flat, or generally so. However, the underside could be shaped to conform to any non-flat surface.

Figure 4:
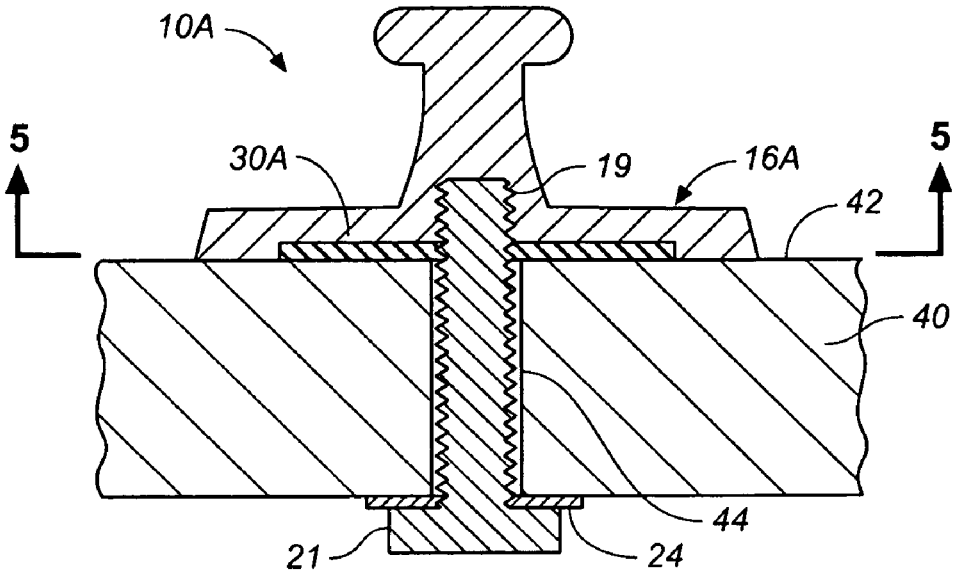
FIG. 4 is a cross-sectional side view in elevation showing an alternative embodiment.

Depending downwardly from each base 16 are threaded rods or bolts 20, preferably integral to the cleat 10. The threaded rods pass through bolt holes or apertures 44 in the vessel deck 40 and are received by a threaded female member 22, such as a nut, optionally, a washer 24 interposed between the nut and the underside of the deck. Conversely, the threaded female member may be the base itself, wherein threaded bores 19 are disposed in each base to accept bolts 21 installed from the underside of the deck, as shown in FIGS. 4 and 5.

Base 16 includes a recess surface 26 on its underside, the recess surface having a perimeter 28 smaller than that of the base 16 and surrounded by a perimeter wall 34 depending downwardly from the base underside, thereby forming a recess region 32. A gasket 30 encircles rod 20 and fills the recess region 32. The recess region 32 accepts the entirety of gasket 30 before installation, and during installation, the gasket deforms under pressure, but not so much as to extend underneath and protrude from the underside rim 18' of the perimeter wall 34. To accomplish the appropriate deformation, the washer 30 is preferably composed of a resilient compressible material such as PVC, neoprene, rubber, silicone or the like, either singly or in combination.

Accordingly, when the nuts 22 are tightened, the base undersides and underside rims 18' are drawn to the surface 42 of deck 40. At the same time, the gaskets 30 are compressed and captured between the deck surface 42 and the perimeter walls 34, as seen in FIG. 2B. The installed gasket is thus compressed in a controlled manner providing both displacement and compression limits both laterally and vertically. This provides a controlled X/Y axis compression that is not affected if nut 22 is over tightened. This configuration increases the sealing effectiveness on the mounting bolts laterally and the cleat to deck seal vertically. Further, compression remains static in the gasket irrespective of the cleat loads. Because the gasket compression does not vary and is protected from the outside elements in this configuration, the gasket will retain its integrity for an extended period of time. The containment ability of the skirt-like perimeter wall 34 provides stability of the cleat base to the deck with controlled gasket compression regardless of cleat loads associated with mooring a boat and the like. This secure attachment of the cleat base reduces flex loads on the mounting bolts and eliminates spike compression loads that could fatigue and distort the gasket causing water leaks through the deck.

Figure 5:
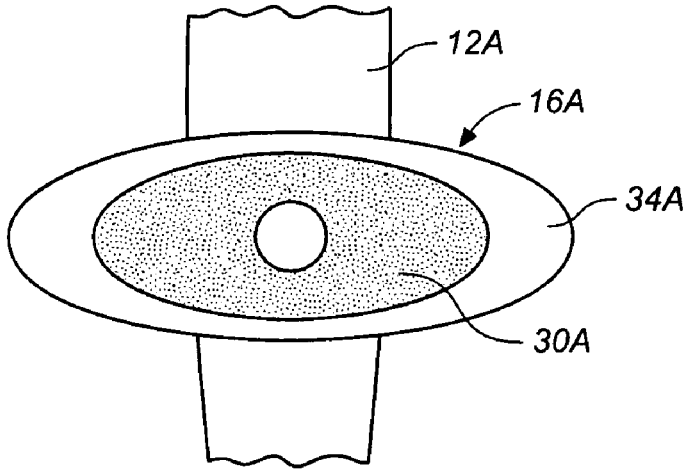
FIG. 5 is a bottom view taken along section line 4-4 in FIG. 4.

FIG. 5 shows a bottom view of an alternate embodiment. The base 16A is wider than in the first embodiment to provide more stability, and the perimeter wall 34A varies in thickness or width to yield more surface area to distribute loads.

Figure 6:
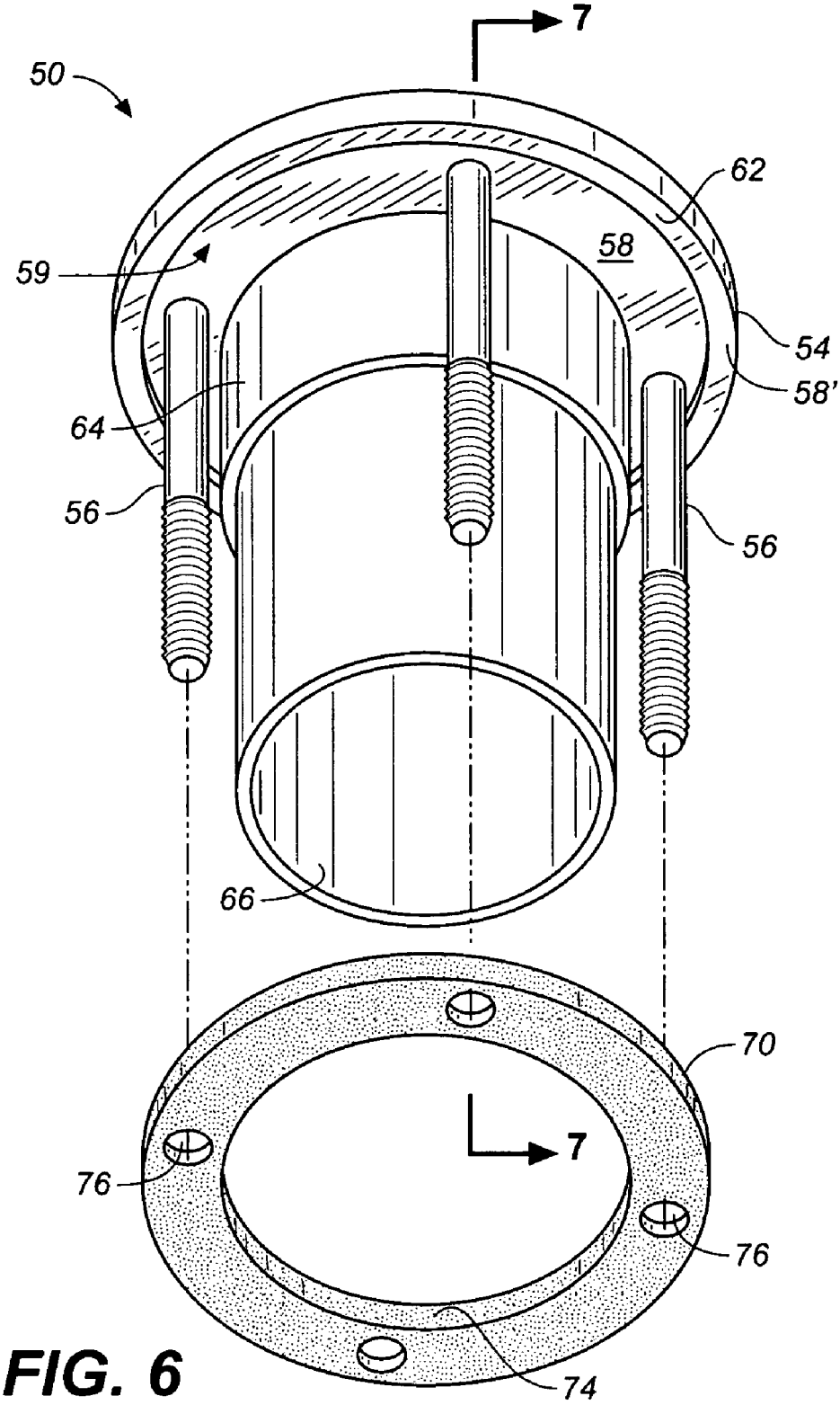
FIG. 6 is a lower exploded perspective of another embodiment of the invention.
Figure 7B:
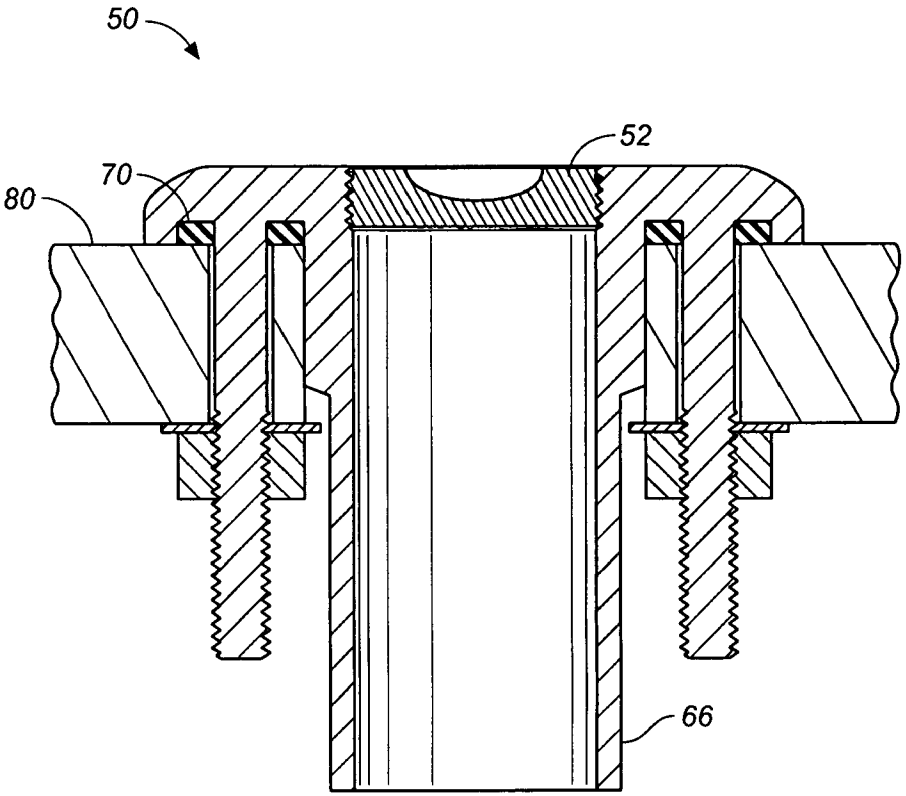
FIG. 7B is the same view as FIG. 7A after installation on a vessel deck.
Figure 7A:
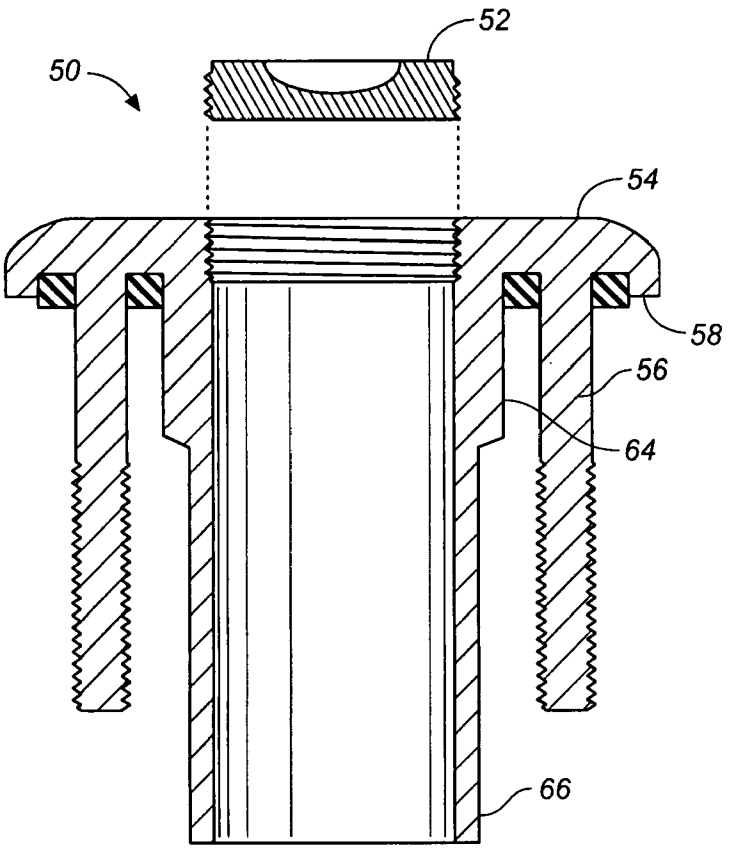
FIG. 7A is a cross-sectional side view in elevation taken along section line 7-7 in FIG. 6, showing a gasket disposed in a gasket recess for installation.

FIGS. 6 and 7 show an alternate embodiment wherein there are a plurality of apertures in the gasket associated with mounting rods, and the gasket itself encircles a feed-thru. Specifically, this exemplary embodiment is a fill and cap assembly, generally denominated 50. Generally an assembly 50 will feature a cap 52 that cooperates with a fill tube 54, which is fixedly mounted to a surface 80. In this instance there are a plurality of integral threaded rods 56 depending down from the underside 58 of the assembly. On the underside 58 is a recessed region 59 bounded on the outside by a perimeter wall 62 having an underside rim 58' and on the inside by the exterior wall 64 of feed-thru 66. Located in between these boundaries are the mounting studs 56 so that a gasket 70 can encircle each stud 56 and the feed-thru 66. The gasket 70 has an aperture 74 for the feed-thru 66 and apertures 76 aligned and located to match the mounting studs 56.

FIG. 7B is the assembly in cross-section after installation showing the gasket 70 compressed and contained between the feed-thru 66, perimeter wall 58, recess 59, and mounting surface 80.

Figure 8:
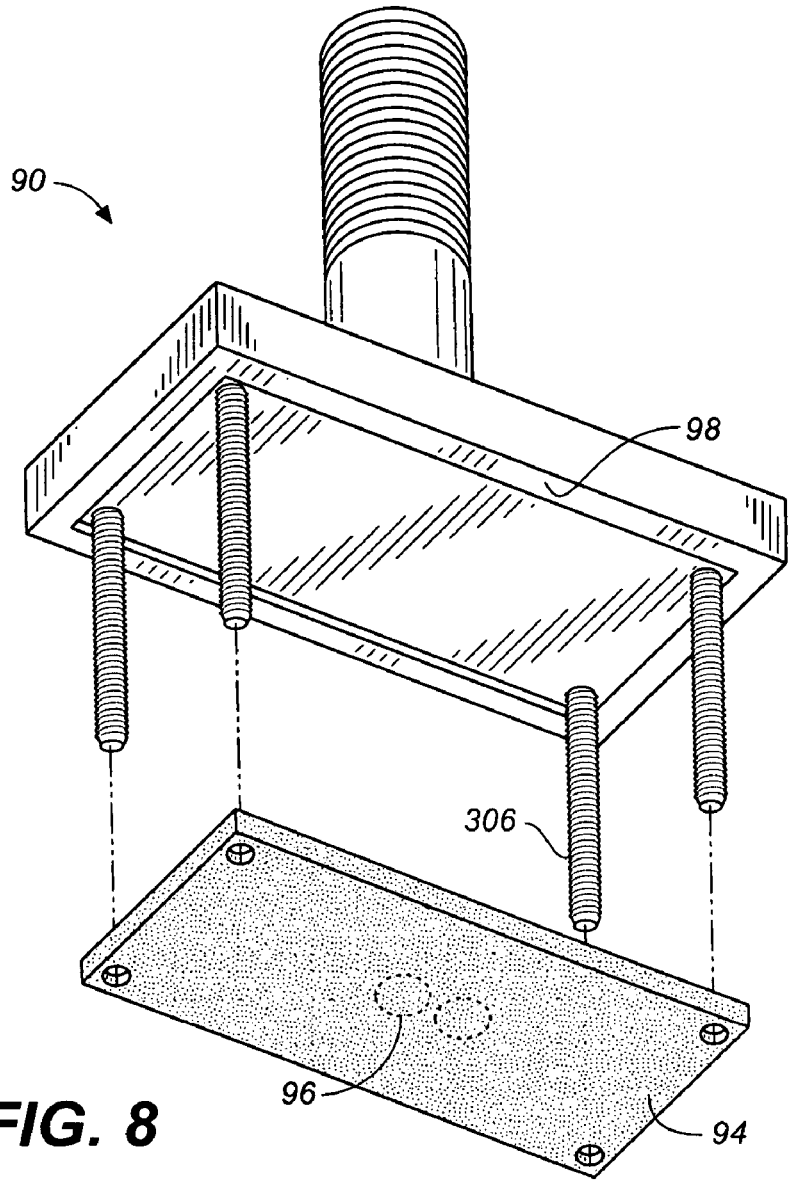
FIG. 8 is an exploded perspective of another alternative embodiment of the inventive method and apparatus.

FIG. 8 shows the inventive device as utilized in yet another alternate embodiment, namely an exemplary hardware mount 90 for devices such as antennas (not shown). No feed-thrus are shown, however, this design allows for a plurality of apertures, indicated on gasket 94 by dashed circles 96, that could be contained well inside the perimeter skirt 98.

Although not shown, combinations of the forgoing could easily be achieved, including a single mounting rod with a central bore that also functions as a feed-thru. There could be a plurality of feed-thrus with some of them also acting as mounting means. These combinations would exhibit the common characteristics of containment and load isolation of the gasket with the goal of preserving the gaskets sealing attributes and there by extending it's useful life.

Accordingly, in its most essential aspect, it will be seen that the inventive apparatus is a device for installation on the surface of a vessel deck. The vessel deck is provided with one or more bolt holes for the insertion of fasteners (either rods or bolts), and the device includes one or more base portions, each having a recess region defined by a perimeter wall bounding the perimeter of the base portion. The perimeter walls each have an underside rim. One or more threaded members are provided for insertion through the bolt holes in the vessel deck, and complementary threaded female members are provided, one each to receive and tighten onto a threaded rod. A resilient gasket is disposed in the recess region within the confines of the perimeter wall. The threaded rod passes through the gasket hole. Accordingly, when the threaded rods are inserted through the vessel deck, and received by and tightened into the respective threaded female members, the gaskets are displaced and deformed so as to protrude between the underside rims of the perimeter walls and the upper surface of the vessel deck.

The above disclosure is sufficient to enable one of ordinary skill in the art to practice the invention, and provides the best mode of practicing the invention presently contemplated by the inventor. While there is provided herein a full and complete disclosure of the preferred embodiments of this invention, it is not desired to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like.

Therefore, the above description and illustrations should not be construed as limiting the scope of the invention, which is defined by the appended claims.

What is claimed as invention is:

1. An apparatus for installation on the surface of a vessel deck, the vessel deck having one or more bolt holes, said apparatus comprising:

at least one base portion, each base portion having a recess bounded by a perimeter wall with an underside rim so as to define a recess region;

one or more threaded rods, each threaded rod adapted for insertion through one of the bolt holes in the vessel deck;

at least one threaded female member, one each for receiving one of said threaded rods when said threaded rods are inserted through the vessel deck; and at least one resilient gasket disposed in the recess region within the confines of each of said perimeter walls and over one of said threaded rods;

such that when said threaded rods are inserted through the bolt holes in the vessel deck, and received by and tightened into said threaded female members, said gaskets are displaced and deformed in a controlled X/Y axis compression between said perimeter walls and said vessel deck, and such that after tightening of said threaded rods into said threaded female members sufficiently to bring said underside rim into contact with said vessel deck, said gasket is protected from exposure to outside elements and further compression of said gaskets remains static.

2. The apparatus of claim 1, wherein each of said threaded rods is integral to one of said base portions and said female member is a nut that receives said threaded rod when said threaded rod is inserted through a bolt hole in the vessel deck.

3. The apparatus of claim 1, wherein said threaded rod is a bolt and said base is provided with apertures having female threads so as to receive said bolt.

4. The apparatus of claim 1, wherein said apparatus is a cleat having at least two base portions.

5. The apparatus of claim 1, wherein said apparatus is a fill cap which includes a feed through.

6. The apparatus of claim 1, wherein said apparatus is an antenna mount.

7. The apparatus of claim 1, wherein said installed gasket provides displacement and compression limits laterally and vertically.

8. The apparatus of claim 7, wherein the compression of said gasket on installation is a controlled X/Y axis compression that is not affected if said threaded female member is over tightened.

9. An apparatus for installation on the surface of a vessel deck, the vessel deck having one or more bolt holes, said apparatus comprising:

at least one base portion, each base portion having a recess bounded by a perimeter wall with an underside rim so as to define a recess region:

one or more threaded rods, each threaded rod adapted for insertion through one of the bolt holes in the vessel deck;

at least one threaded female member, one each for receiving one of said threaded rods when said threaded rods are inserted through the vessel deck; and at least one resilient gasket disposed in the recess region within the confines of each of said perimeter walls and over one of said threaded rods;

such that when said threaded rods are inserted through the bolt holes in the vessel deck, and received by and tightened into said threaded female members, said gaskets are displaced and deformed so as to protrude between said underside rim of said perimeter wall and the upper surface of the vessel deck;

wherein the thickness of said perimeter wall has variable thickness so as to provide more surface area to distribute loads.

10. A cleat for installation on the surface of a vessel deck, the vessel deck having one or more bolt holes, said apparatus comprising:

at least two base portions, each base portion having a recess bounded by a perimeter wall with an underside rim so as to define a recess region;

one or more threaded rods, each threaded rod adapted for insertion through one of the bolt holes in the vessel deck;

at least one threaded female member, one each for receiving one of said threaded rods when said threaded rods are inserted through the vessel deck; and at least one resilient gasket disposed in the recess region within the confines of each of said perimeter walls and over one of said threaded rods;

such that when said threaded rods are inserted through the bolt holes in the vessel deck, and received by and tightened into said threaded female members, said gaskets are displaced and deformed so as to protrude between said underside rim of said perimeter wall and the upper surface of the vessel deck.

* * * * *